US010687682B2

(12) United States Patent
Petit

(10) Patent No.: US 10,687,682 B2
(45) Date of Patent: Jun. 23, 2020

(54) APPLICATOR STORAGE BOX

(71) Applicant: Brendan Petit, Orlando, FL (US)

(72) Inventor: Brendan Petit, Orlando, FL (US)

( * ) Notice: Subject to any disclaimer, the term of this patent is extended or adjusted under 35 U.S.C. 154(b) by 0 days.

(21) Appl. No.: 16/160,082

(22) Filed: Oct. 15, 2018

(65) Prior Publication Data

US 2020/0113403 A1 Apr. 16, 2020

(51) Int. Cl.

| | |
|---|---|
| ***A47L 13/286*** | (2006.01) |
| ***A47L 13/30*** | (2006.01) |
| ***A47L 13/16*** | (2006.01) |
| ***A47B 81/02*** | (2006.01) |
| ***B44D 3/12*** | (2006.01) |

(52) U.S. Cl.

CPC ..... *A47L 13/286* (2013.01); *A47B 81/02* (2013.01); *A47L 13/16* (2013.01); *A47L 13/30* (2013.01); *B44D 3/125* (2013.01)

(58) Field of Classification Search

CPC ..... A47L 13/26; A47L 13/30; A47L 13/16; A47L 13/286; A46B 11/00; A46B 11/0072; A46B 11/0093; A45D 34/045; A45D 34/046; A45D 34/047; A45D 34/048; A45D 40/265; A45D 40/267; A45D 40/268; A47B 81/02; A47B 81/00; B44D 3/12; B44D 3/125

See application file for complete search history.

(56) References Cited

U.S. PATENT DOCUMENTS

| | | | | | |
|---|---|---|---|---|---|
| 1,540,829 | A * | 6/1925 | Burnett | B43M 11/04 | 401/130 |
| 2,026,890 | A * | 1/1936 | Gross | B65D 51/32 | 401/129 |
| 5,037,226 | A * | 8/1991 | Davis | B43M 5/02 | 156/441.5 |
| 5,314,061 | A * | 5/1994 | Bedrossian | B44D 3/121 | 206/15.2 |
| 5,806,704 | A * | 9/1998 | Jamison | B44D 3/125 | 206/15.3 |
| 8,286,790 | B1 * | 10/2012 | McBryar | B44D 3/006 | 15/104.92 |
| 8,376,179 | B2 * | 2/2013 | Horton | B65D 43/16 | 220/735 |
| 2006/0108192 | A1 * | 5/2006 | Bastarache | A45C 5/14 | 190/18 A |

* cited by examiner

*Primary Examiner* — David J Walczak
(74) *Attorney, Agent, or Firm* — Jason T. Daniel, Esq.; Daniel Law Offices, P.A.

(57) ABSTRACT

A floor finish applicator storage box includes a main body having an open top end, a closed bottom end and a plurality of sides that define a watertight interior space. A lid having an applicator attachment mechanism extending outward from the bottom surface is removably secured to the main body via connectors. The box including a shape and dimension that is suitable for receiving a floor finish applicator that is secured to the lid, and for suspending the applicator within a solution contained within the main body.

14 Claims, 4 Drawing Sheets

APPLICATOR STORAGE BOX

TECHNICAL FIELD

The present invention relates generally to storage devices, and more particularly to a wet storage box for use with a flooring applicator.

BACKGROUND

The statements in this section merely provide background information related to the present disclosure and may not constitute prior art.

When applying a finishing product such as varnish or urethane, for example, to hard flooring it is necessary to utilize an applicator. Background FIG. 1 illustrates one embodiment of a common floor finish applicator 1 that includes a generally T-shaped frame 2 having a threaded receiver 3 for engaging a pole or shaft, and a coating head 4.

Depending on the finishing product to be utilized, the coating head may be constructed from a malleable absorbent material such as a sponge, or from a malleable non-absorbent material such as rubber, for example. In either instance, the coating heads must be somewhat pliable in order to evenly distribute the flooring product onto the floor surface.

Owing to the drying and hardening properties of the finishing products, applicator coating heads typically harden and become unusable within 24-48 hours from initial use. When this occurs, users must either purchase a new applicator, or a new applicator coating head.

Although this is of little concern to homeowners or other individuals who do not routinely finish floors, it becomes a great expense to professionals who must constantly purchase new applicators in the course of their employment.

Accordingly, it would be beneficial to provide a wet storage box having functionality for receiving a used applicator and suspending the same in a liquid solution that can allow the applicator to be reused indefinitely, so as to alleviate the drawbacks described above.

SUMMARY OF THE INVENTION

The present invention is directed to a floor finish applicator storage box. One embodiment of the present invention can include a main body having an open top end, a closed bottom end and a plurality of sides that define a watertight interior space. The box can include a lid having a shape and size that is complementary to the shape and size of the open top end of the main body. The lid includes an applicator attachment mechanism along the bottom surface for engaging a floor finish applicator.

The lid can be removably secured to the main body via connectors, and the main body includes a shape and dimension that is suitable for receiving a floor finish applicator that is secured to the lid. The main body also functioning to receive and store a liquid solution into which the floor finish applicator can be suspended.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the terms "connector" and "complementary connector" include any number of different elements that work together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

As described throughout this document, the term "complementary shape," and "complementary dimension," shall be used to describe a shape and size of a component that is identical to, or substantially identical to the shape and size of another identified component.

Figure 1:
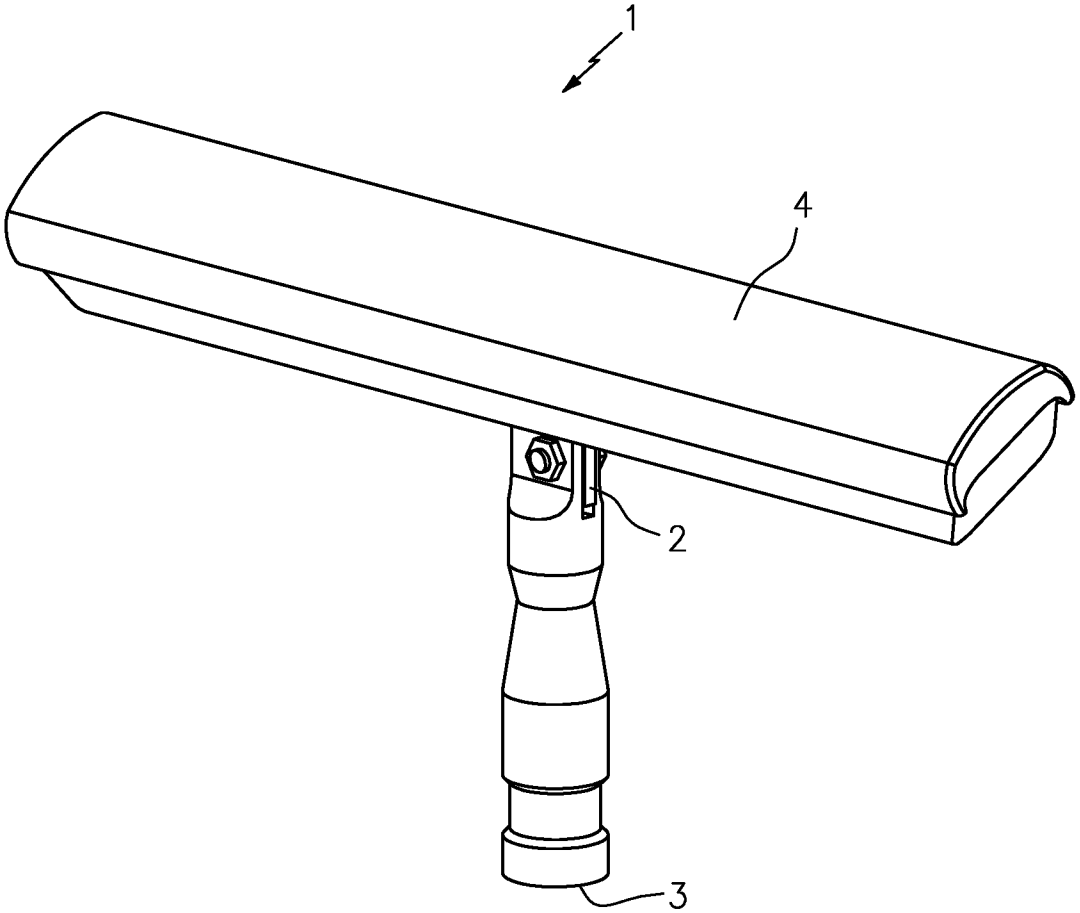
FIG. 1 (Background Art)
FIG. 1 is a bottom view of a finish floor applicator 1, in accordance with background art.
Figure 2:
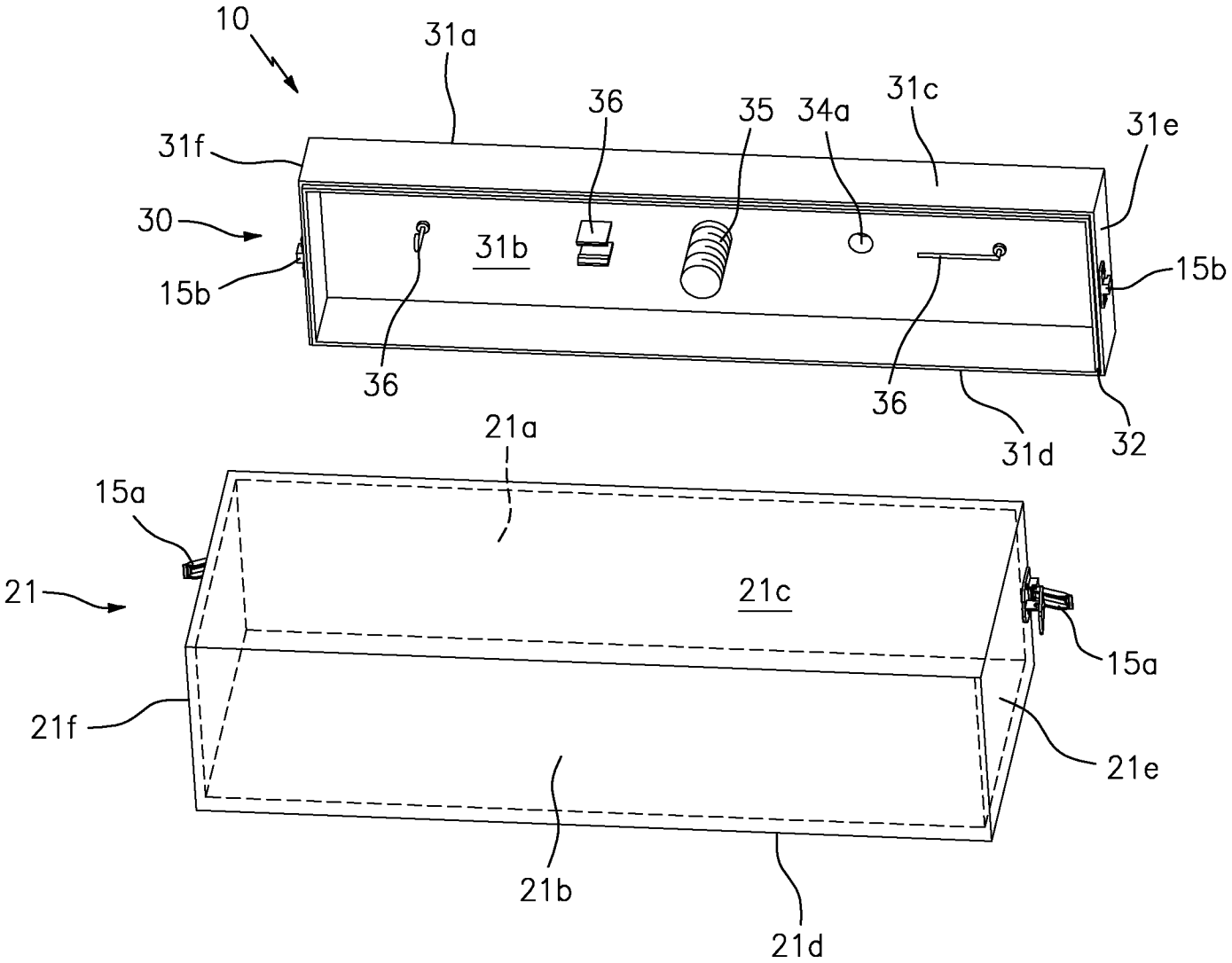
FIG. 2 is an exploded parts view of the applicator storage box, in accordance with one embodiment of the invention.
Figure 3:
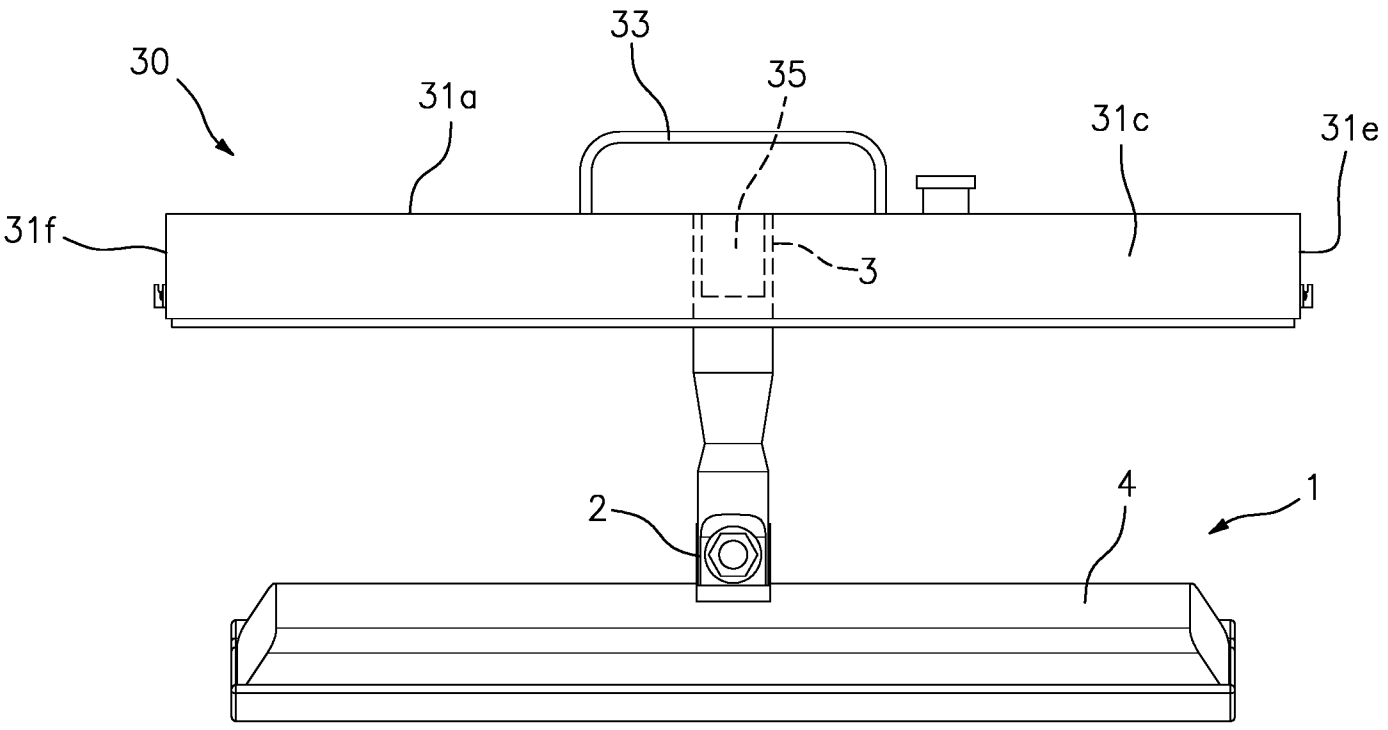
FIG. 3 is a side view of the lid of the applicator storage box in operation, in accordance with one embodiment of the invention.
Figure 4:
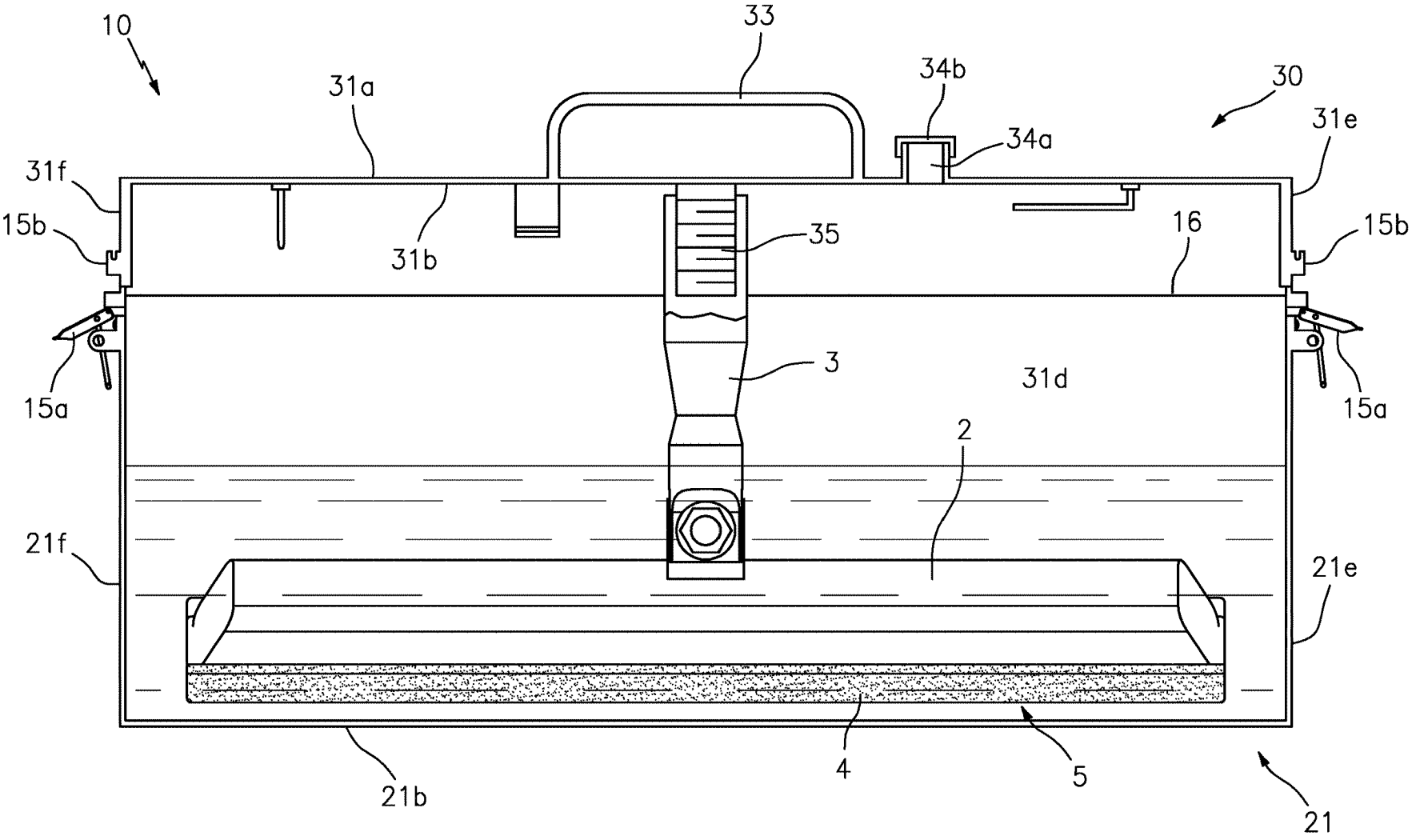
FIG. 4 is a front view of the applicator storage box in operation, in accordance with one embodiment of the invention, wherein the front surfaces of the lid and main body are removed for ease of illustration.

FIGS. 2-4 illustrate one embodiment of an applicator storage box 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 2.

As shown best in FIG. 2, one embodiment of the box 10 can include a main body 21 and a lid 30 having an applicator attachment mechanism 35 positioned thereon.

In one embodiment, the main body 21 can include a generally rectangular shape having an open top end 21*a*, a closed bottom end 21*b*, a front surface 21*c*, a back surface

21*d*, and a pair of side surfaces 21*e* and 21*f*, that define a watertight and hollow interior space for storing a liquid solution.

As described herein, the main body 21 may be formed from materials that are, for example, relatively strong and stiff for their weight. Several nonlimiting examples include but are not limited to various metals or metal alloys (e.g., aluminum, steel, titanium, or alloys thereof), plastic/polymers (e.g., high-density polyethylene (HDPE), rigid polyvinyl chloride (PVC), or polyethylene terephthalate (PET)), and/or various composite materials (e.g., carbon fibers in a polymer matrix, fiberglass, etc.).

The lid 30 can also include a generally rectangular-shaped member having a top surface 31*a which is elongated along a major axis thereof*, bottom surface 31*b*, a front surface 31*c*, a back surface 31*d*, and a pair of side surfaces 31*e* and 31*f*. The lid 30 will preferably include a shape and size that is complementary to the shape and size of the top portion of the main body 21*a* so as to be positionable thereon. In one embodiment, an elastomeric gasket 32 or other such material can be positioned along the periphery of the lid 30 and/or main body 21 so as to maintain an airtight and watertight interior space when the lid is secured in the closed position.

In this regard, the lid 30 can be secured to the main body 21 via any number of known connectors. In the preferred embodiment, the connectors can include a pair of T-handle rubber draw latches 15*a* that are secured along the sides of the main body 21*e* and 21*f*, respectively. The latches functioning to engage nubs 15*b* that are positioned along the sides of the lid 31*e* and 31*f*, respectively.

Although described above as including generally rectangular-shaped elements, the inventive concepts are not limited to this shape, as any number of different shapes and sizes are contemplated. Moreover, any number of other types of connectors are contemplated, and each connector can be positioned anywhere along the main body 21 and/or the lid 30. For example, another embodiment of the device 10 can include a hinge 16 (See FIG. 4) that is interposed between the lid and main body, so as to allow the lid to pivot between an open and closed orientation.

The applicator attachment mechanism 35 is elongated along a major axis thereof and can be positioned along the bottom surface of the lid 30 and can function to engage any number of commercially available applicators. In the preferred embodiment, the mechanism 35 can include a threaded post for engaging the threaded receiver 3 of an applicator 1 via a twisting motion.

In various embodiments, the lid 30 and attachment mechanism 35 may be constructed from identical materials as the main body 21 or may be constructed from any number of different materials. To this end, the lid can be manufactured from a single mold of material to include the attachment mechanism as a unitary element or may be manufactured as two separate components that are joined together in accordance with known manufacturing techniques.

Although described above as including a threaded post for engaging the threaded receiver of an applicator, the inventive concepts are not limited to this arrangement, as the attachment mechanism 35 can include, comprise or consist of any number of different elements capable of engaging an applicator and securing the same within the main body. Several nonlimiting examples include any of the above noted connectors, along with various clamps, hooks, or shelving members such as angled rods, for example.

Moreover, various embodiments of the device 10 contemplate one or more accessory attachment mechanisms 36 capable of engaging a secondary applicator and/or work accessories such as brushes or rollers, for example. As described herein, the accessory attachment mechanism(s) 36 can include or comprise any of the components described above with regard to the applicator attachment mechanism 35.

In addition to the above, various embodiments of the device 10 can include a carrying handle 33 that can be positioned along the top surface of the lid to aid in transporting the device. Likewise, an aperture 34*a* having a removable cap 34*b* can be positioned along the lid 30. The aperture and cap can function to allow a user to fill the interior space of the main body with a solution and/or to check on the level of solution within the main body without having to remove the entire lid. The cap can be constructed from a transparent material to allow a user to visually inspect the solution level within the main body. Such features being beneficial for preserving the lifespan of the solution within the container by minimizing air exposure to the same.

FIGS. 3 and 4 illustrate one embodiment of the device 10 in operation. As shown, when the box 10 is in the open position, an applicator 1 can be secured to the lid 30 via the attachment mechanism 35. When so positioned, the coating head 4 of the applicator will extend outward from the bottom surface of the lid 31*b*.

As shown in FIG. 4, where the front surfaces 21*c* and 31*c* are removed for ease of illustration, when the lid 30 is secured onto the main body 21, the applicator head 4 will be submerged in a solution 5 such as water or mineral spirit, for example. As the interior space of the main body is both air and watertight, the solution can function to preserve the applicator until it is ready to be used again, thus alleviating the need and expense of purchasing a new applicator or applicator head for the next job.

As the box 10 is designed to receive and store floor finish applicators, it is important that the main body and lid include dimensions that are complementary to the dimensions of standard-sized flooring applicators. Therefore, in the preferred embodiment, the main body can include a length (e.g., distance between inside facing surfaces 21*e* and 21*f*) of approximately 18 inches, and a height (e.g., distance between top and bottom ends 21*a* and 21*b* of approximately 9 inches. Such dimensions being particularly adapted for use with professional grade floor finishing applicators having a standard dimension of 17 inches in length, and 6 inches in height.

Of course, other embodiments are contemplated wherein different dimensions are provided so as to accommodate flooring applicators having different shapes and sizes.

As described herein, one or more elements of the storage box 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An applicator storage device, comprising:

an elongated, generally rectangular-shaped main body having an open top end, a closed bottom end, and a plurality of sides that define a watertight interior space;

a lid that is configured to engage the open top end of the main body and to transition between an open position and a closed position, said lid including a top surface, a bottom surface and a plurality of side surfaces; and an applicator attachment mechanism that is positioned along the bottom surface of the lid, said applicator attachment mechanism having a major axis that is perpendicular to a major axis of the lid, and said applicator attachment mechanism comprising a threaded post having a shape and size that is configured to engage a threaded receiver of a floor finish applicator and to position a distal end of the engaged floor finish applicator adjacent to the closed bottom end of the main body.

2. The device of claim 1, further comprising:

a gasket that is positioned along the lid.

3. The device of claim 1, further comprising:

at least one connector that is configured to removably secure the lid to the main body.

4. The device of claim 3, wherein the at least one connector comprises:

a pair of T-handle rubber draw latches that are positioned along the main body, and a pair of nubs that are positioned along the lid.

5. The device of claim 1, further comprising:

at least one accessory attachment mechanism that is secured along the bottom surface of the lid, said at least one accessory attachment mechanism being positioned inside an interior space of the when the lid is in the closed position.

6. The device of claim 5, wherein the at least one accessory attachment mechanism includes a hook.

7. The device of claim 5, wherein the at least one accessory attachment mechanism includes a clamp.

8. The device of claim 5, wherein the at least one accessory attachment mechanism includes an angled rod.

9. The device of claim 5, wherein the at least one accessory attachment mechanism includes each of a hook, a clamp and an angled rod.

10. The device of claim 1, further comprising:

a hinge that is positioned along a major axis of each of the main body and the lid.

11. The device of claim 1, further comprising:

an aperture that is positioned along the lid.

12. The device of claim 11, further comprising:

a cap that is removably secured along the aperture.

13. The device of claim 12, wherein the cap is constructed from a transparent material.

14. An applicator storage device, consisting of:

an elongated, rectangular-shaped main body having an open top end, a closed bottom end, and a plurality of sides that define a watertight interior space;

a lid that is configured to engage the open top end of the main body and to transition between an open position and a closed position, said lid comprising a top surface, a bottom surface and a plurality of side surfaces; and an applicator attachment mechanism that is secured to the bottom surface of the lid, said applicator attachment mechanism comprising a threaded post having a major axis that is perpendicular to a major axis of the lid.

* * * * *